US012441444B2

(12) United States Patent
Hamet

(10) Patent No.: US 12,441,444 B2
(45) Date of Patent: Oct. 14, 2025

(54) PROTECTING SURFACES FROM BIOFOULING SPECIES

(71) Applicant: James Hamet, Riverside, CT (US)

(72) Inventor: James Hamet, Riverside, CT (US)

( * ) Notice: Subject to any disclaimer, the term of this patent is extended or adjusted under 35 U.S.C. 154(b) by 118 days.

(21) Appl. No.: 17/947,120

(22) Filed: Sep. 17, 2022

(65) Prior Publication Data

US 2023/0085870 A1 Mar. 23, 2023

Related U.S. Application Data

(60) Provisional application No. 63/245,635, filed on Sep. 17, 2021.

(51) Int. Cl.
*B63B 59/04* (2006.01)

(52) U.S. Cl.
CPC ..... *B63B 59/04* (2013.01)

(58) Field of Classification Search
CPC ..... B63B 59/04; B63B 59/045
See application file for complete search history.

(56) References Cited

U.S. PATENT DOCUMENTS 3,968,286 A * 7/1976 Megumi ..... B32B 21/04 442/13
2011/0024026 A1* 2/2011 Jonsson ..... B63B 5/24 156/154
2018/0094204 A1* 4/2018 Larimer ..... C10M 107/50

FOREIGN PATENT DOCUMENTS

CN 207809681 U * 9/2018
GB 2040232 A * 8/1980

OTHER PUBLICATIONS

CN207809681U Machine Translation of Description (Year: 2025).*

* cited by examiner

*Primary Examiner* — Cynthia L Schaller
(74) *Attorney, Agent, or Firm* — Cognition IP, P.C.; Edward Steakley; Rajesh Fotedar

(57) ABSTRACT

According to various embodiments, an apparatus includes an adhesive layer disposed on a first side of a porous layer. A plurality of bound wire mesh layers are attached to a second side of the porous layer. One or more pores of the porous layer correspond to one or more air gaps between the bound wire mesh layers and the porous layer. The apparatus further includes a characteristic of a presence of an extent of surface tension at (or throughout) the bound wire mesh layers. Each of the one or more air gaps further corresponds to one or more opening portions of a wire strand layer(s) in the bound wire strand layers. Other embodiments are directed to a method to configure the apparatus.

14 Claims, 2 Drawing Sheets

PROTECTING SURFACES FROM BIOFOULING SPECIES

CROSS-REFERENCE TO RELATED APPLICATIONS

This application claims priority to U.S. Provisional Patent Application No. 63/245,635, filed Sep. 17, 2021, which is hereby incorporated by reference in its entirety.

FIELD OF THE INVENTION

The present invention relates to preventing biofouling of mechanisms and surfaces.

BACKGROUND OF THE INVENTION

Biofouling is the accumulation of microorganisms, plants, fungi, algae, or animals on wetted surfaces. This problem is felt worldwide; biofouling occurs almost anywhere there is water and on almost any kind of material. Furthermore, biofouling can be extremely damaging to the integrity of off-shore platforms, the undersides of ships, and parts of scientific instruments. In fact, the damage is so important that a widely accepted solution to the problem is a combination of toxic paints that, while regulated, cause serious damage to the marine ecosystem and require regular re-application.

The biofouling problem could be most painfully felt by the shipping industry, where barnacle infestations greatly affect the economics of shipping, increasing drag by up to 60% and increasing fuel consumption by up to 40%. The most problematic of these biofouling organisms include macrofoulers: shell-forming, invertebrate calcareous (hard calcium and shell forming) animals such as barnacles, mussels, and shipworms (marine wood borers). They develop and spread quickly, achieving a density of 343 kg/m2 in the South China Sea and contributing most significantly to the increase in drag due to their size and shape.

SUMMARY

Macrofoulers fixate to a surface by first traveling in larval form through water, finding a desirable surface, developing to a juvenile adult within 6 to 24 hours, and then performing repeated molting cycles. In these cycles, the juvenile adult enlarges its shell and secretes adhesive barnacle cement to fill gaps between the barnacle's enlarging base plate and the substrate, cure within a few hours. Within 2 to 3 weeks, the barnacle (or any other type of macrofouler) is visible and well established.

Many conventional solutions for preventing biofouling have been deployed over the millennia with a large focus on poisoning the organism before it is well established on the substrate. For example, conventional techniques include: self-polishing and application of tin-based biotoxic paints. Such paints were eventually found to be so toxic that they have been banned worldwide. Copper sheathing and copper oxide-based paints are also toxic and have been used, but provide only a limited lifespan of effectiveness due to leaching into the water and significantly damaging the local marine ecosystem. While modern conventional adhesives permit application of copper alloys to steel hulls without creating galvanic corrosion, the copper still present in the material produces an unacceptable environmental impact. Cuprous oxide and other copper salts, such as copper thiocyanate, converted into copper oxychloride, are also both highly bio-toxic for biofouling animal species and to desirable aquatic species. As such, cuprous oxide has also been banned from use in several jurisdictions.

A method for protecting surfaces from biofouling includes applying a coating with a microtopographical structure unconducive to biofouling attachment. When applied, it acts as a physical barrier that cannot be attached to or passed through by macrofoulers in the larval stage. These properties are possible with a structure having no surfaces of constant width large enough to support a larva to fix to and form a base plate, with gaps or pores between surfaces small enough that the larva also may not traverse through the material, and with gaps or pores deep enough and granted exits such that they cannot be filled with adhesive barnacle cement. This non-toxic solution to the biofouling problem offers elegant protection of submerged surfaces from biofouling, desirable not only to those who otherwise depend on the regular application of toxic paints but also to marine life that would be saved from further toxic development. The protected material can be applied in a number of ways including adhesive such as silicon and bindings such as a thread or staple.

According to various embodiments, a method as described herein includes placing a porous layer upon an adhesive layer and binding wire strand layers. The method further includes attaching a wire strand layer(s) (such as the bound wire strand layers) to the porous layer. The method further generates an extent of surface tension at (or throughout the bound wire strand layers due to presence of one or more air gaps between the porous layer and the bound wire strand layers. Each of the air gaps corresponds to respective pores in the porous layer and one or more opening portions of at least one wire strand layer included in the bound wire strand layers.

According to various embodiments, an apparatus as described herein includes an adhesive layer disposed on a first side of a porous layer. A plurality of bound wire mesh layers are attached to a second side of the porous layer. One or more pores of the porous layer correspond to one or more air gaps between the bound wire mesh layers and the porous layer. The apparatus further includes a characteristic of a presence of an extent of surface tension at (or throughout) the bound wire mesh layers. Each of the one or more air gaps further corresponds to one or more opening portions of a wire strand layer(s) in the bound wire strand layers.

According to various embodiments, a biofouling animal species—such as a barnacle—cannot attach and grow to a ship's hull when the apparatus is attached to the ship's hull. The surface area and surface tension at the bound wire strand layers make it particularly difficult for a barnacle to grow on the bound wire strand layers. The air gaps that correspond to the pores of the porous layer and opening portions amongst the bound wire strand layers prevent the barnacle's glue (or cement) from accumulating at the site of the apparatus and, therefore, interferes with the barnacle's ability to create a surface composed of accumulated glue for attachment.

Therefore, according to some embodiments, the use of the phrase "surface tension" may also be interpreted to describe (or at least include) a characteristic of the apparatus due to respective opening portions of the bound wire strand layers and/or the respective air gaps that correspond to the porous layer being too small for successful entry (or attachment) by a biofouling animal species. In addition, the "surface tension" characteristic may further be due to a small surface area available to a biofouling animal species for possible attachment. That is, for example, one or more size characteristics of respective individual elements of the protecting material are not within a range of size measurement for a surface that is ideal for biofouling animal species attachment.

It is understood that, according to various embodiments, the adhesive layer, the porous layer and the wire strand layer(s) as described herein are not limited to being separate, individual layers that initially exist independently. That is, for example, a layer may be based on a material(s) or composition that includes an adhesive portion and a porous portion. A layer may include an adhesive portion, a porous portion and a wire strand portion(s). A layer may include a porous portion and a wire strand portion(s).

Further areas of applicability of the present disclosure will become apparent from the detailed description, the claims and the drawings. The detailed description and specific examples are intended for illustration only and are not intended to limit the scope of the disclosure.

BRIEF DESCRIPTION OF THE DRAWINGS

The present invention is illustrated by way of example and not limitation in the figures of the accompanying drawings in which like references indicate similar elements.

DETAILED DESCRIPTION OF THE PREFERRED EMBODIMENT

Figure 1:
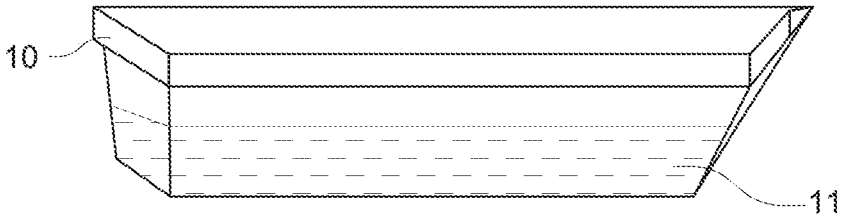
FIG. 1 is a side view of a boat hull with the present invention applied to the exterior.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions. Throughout the description of the preferred embodiment of the present invention, like components will be identified by like reference numerals.

Reference in the specification to "one embodiment" or "an embodiment" or "another embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

This invention describes a process that protects wetted surfaces from these larvae by preventing them from reaching a protected surface and by preventing these larvae from affixing to the protected surface. FIG. 1 is a diagram that illustrates a side view of a boat hull 10 with antifouling coat 11 applied to the outside of the boat hull 10 where it might regularly be wetted.

Figure 2:
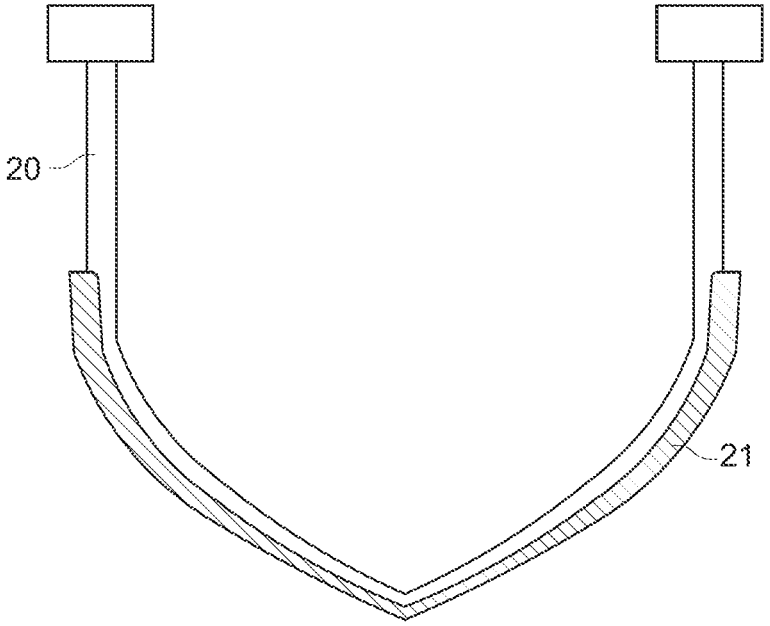
FIG. 2 is a section view of a boat hull with the present invention applied to the exterior.

FIG. 2 shows a cross-section of a boat hull 20 with an antifouling coat 21 applied to the outside of boat hull 20 where it might be regularly wetted. In both cases, respective portions of a boat hull 10, 20 may be covered by an coat 11, 21 are considered to be a protected surface, whereas the antifouling coat 11, 21 22 are considered a protecting surface. According to various embodiments, the antifouling coat 11, 21 may be an anti-biofouling layer or an anti-biofouling apparatus.

Figure 3:
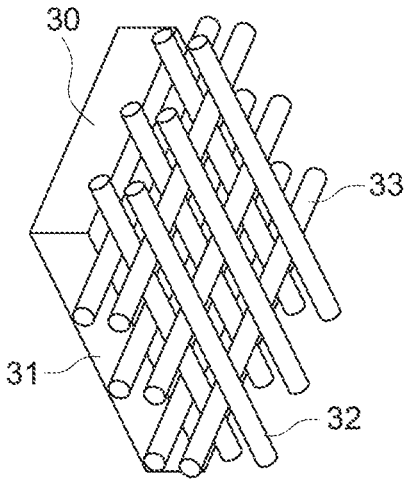
FIG. 3 is a cross-section of a boat hull segment with the applied antifouling coating.

According to one or more embodiments, as shown by the diagram illustrated in FIG. 3, a boat hull segment 30 is protected by one or more layers of antifouling material 33. With this configuration, water must pass through the antifouling material 33 to reach the protected surface 30. This antifouling material 33 is best described by its regions of constant width, herein illustrated with layers of individual wire strands 32 having wires with diameters no larger than 50 microns and having gaps (i.e. opening portions) between the wires 31 no larger than 50 microns.

Specifically, various embodiments may include one or more layers of woven wire mesh composed of wires with a wire diameter less than 21 microns and gaps (i.e. opening portions) between the wires less than 29 microns as well. Since macrofoul larvae tend to exist in many different shapes and sizes, with the smallest being around 50 microns in width, the larvae may not traverse through the one or more layers of woven wire mesh due to the gaps (i.e. opening portions) no greater than 50 microns. The wire diameter will also make it difficult for the larvae to form a baseplate of accumulated cement on one or more layers of woven wire mesh.

According to various embodiments, a method includes a first step of placing a porous layer upon an adhesive layer and a second step of attaching at least one wire strand layer to the porous layer. For example, attaching the wire strand layers(s) may include binding a first wire strand layer between the porous layer and a second wire strand layer. In some embodiments, attaching the wire strand layers further includes applying a crimping mechanism, such as—for example—a staple, upon a portion of an outer wire strand layer. The applied staple pasies through one or more opening portions of respective other wire strand layers and one or more opening portions of each wire strand layer. The staple further attaches to one or more portions of the porous layer.

In various embodiments, attaching bound wire strand layers to the porous layer generates an extent of surface tension at the bound wire stand layers due to presence of one or more air gaps between the porous layer and the bound wire strand layers. For example, each of the one or more air gaps corresponds to respective pores in the porous layer and further corresponds to one or more opening portions amongst the bound wire strand layers.

According to various embodiments, a wire strand layer(s) may be composed of a plurality of wire strands, wherein a diameter of each respective wire strand is less than or equal to 50 microns. A wire strand layer(s) may comprise a wire strand pattern layer. For example, a wire strand pattern layer(s) includes opening portions between its respective wire strands. Each respective opening portion of a wire strand pattern layer(s) may be less than or equal to 50 microns. In various embodiments, the wire strands may be a plurality of stainless steel wire strands. According to various embodiments, a wire strand layer(s) may be composed of a plurality of wire strands, wherein a diameter of each respective wire strand is less than 21 microns. Each respective opening portion of a wire strand pattern layer(s) may be less than 29 microns.

FIG. 3 shows multiple layers of material 33 (such as layers of woven wire mesh) stacked above the protected surface 30. Each layer thereby creates added distance between a prospecting larva and the protected surface 30.

The distance created by the multiple protecting layers 33 prevents adhesive barnacle cement from reaching the protected surface 30 where it might create conditions conducive to larval fixation. The distance additionally creates conditions where adhesive barnacle cement that does fall through opening portions in the protecting layers 33 may be washed away by water flow.

Figure 4:
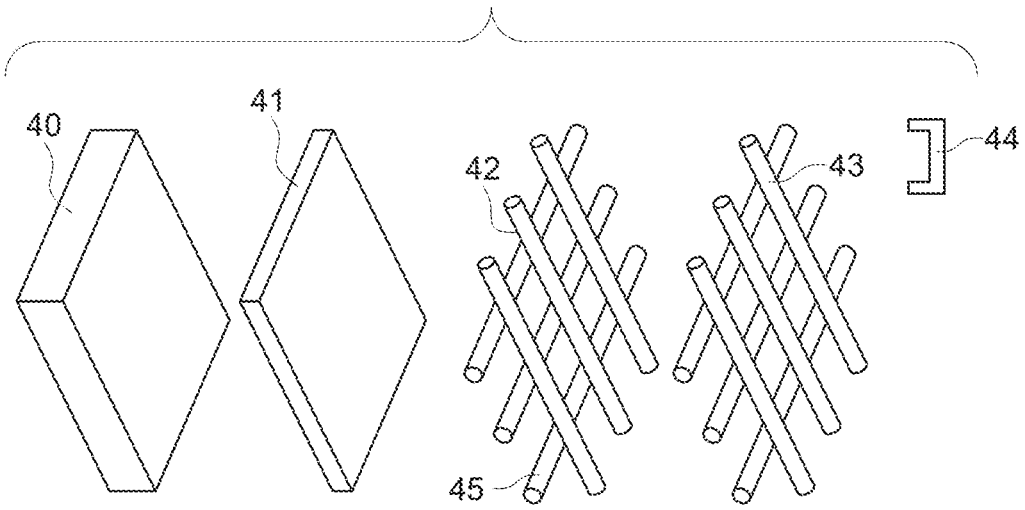
FIG. 4 is an exploded cross-section of a boat hull segment with the applied antifouling coating.

FIG. 4 provides an exploded view of an embodiment, where a protected boat hull segment 40 is protected by layers of antifouling material 42, 43. In addition to the protected surface 40 and protecting layers 42, 43, an adhesive layer 41 is also shown to which the antifouling material layer 42 may adhere. In various embodiments, a porous layer may be situated between the adhesive layer 41 and a protecting layer 42. In other embodiments, the adhesive layer 41 may also be porous.

In various embodiments, a staple 44 binds the protecting layers 42, 43 together with a porous layer and/or the adhesive layer 41. It is understood that adhesive layer 41 and/or a porous layer further permits the future removal and replacement of the staple 44 and any of the protecting layers 42, 43. It is also understood that the protecting layers 42, 43 have gaps (i.e opening portions) between individual strands 45 of each protecting layer 42, 43.

According to one or more embodiments, the adhesive layer 41 may include a porous portion that provides the same functionality and/or effect as the porous layer as described herein. In other embodiments, the adhesive layer 41 may itself have porous characteristics such that the adhesive layer 41 is also the porous layer. In some embodiments, the protecting layers 42, 43 may themselves also form the porous layer as described herein.

Attaching the protecting material (i.e. the wire strand layer(s), the porous layer and the adhesive layer) to the protected material (e.g. a ship's hull) may be done in many ways, such as adhesion via silicon glue or vinyl sheets. A staple(s) may be placed in areas that are not wetted and may be protected with a temporary material cup that can be discarded and replaced as the cup experiences biofouling. In some embodiments, one or more staples or strings may pass through the layers in the protecting material to tie it to the adhesive layer and/or porous layer.

The material used to create any of the layers (such as the bound wire mesh layers) in the protecting material, can be made with any substance, such as, for example, stainless steel, plastics, polymers, and various types of metals. The protecting material may also be enhanced to have biocidal properties with appropriate chemical coatings such that it is even more resistant to barnacle growth.

In an embodiment, an ideal number of bound layers may be determined by measuring the additional drag created by each layer I and contrasting this against the reduced probability of barnacle larvae fixation. Furthermore, various embodiments may have opening portions of the layers at various sizes. The opening portions may be based on a foam structure, voronoi cell structure or any type of microtopographic structure.

The protected material (e.g. a ship's hull) herein described may in fact be composed of any material(s): steel, fiberglass, plastic, or other. The protected material may already have applied antifouling coatings and paints including biocidal paint and the protecting material may in fact create a safer environment for marine life by reducing the rate of leaching and by trapping particles of the biocial material close to the protected surface.

Affixing the protecting material (i.e. the wire strand layer(s), the porous layer and the adhesive layer) should maintain the porous and air gap characteristics described herein to prevent any elements to create a seal that provides a suitable surface for barnacle attachment. Affixing the protecting material may include sewing the protecting material to a layer underneath with fine thread. Affixing the protecting material may include crimping the edges of the protecting material such that the protecting material covers the protected material with an air-gap. Crimping may result in a seal around an area of the protected material (e.e. A ship's hull) where only that area is in fact protected. Such an area, being protected, would resist biofouling.

Use of an adhesive glue that contains particles such that the surfaces meant to be adhered together are in fact adhered to these particles which act as a middle layer. These particles ideally are pyramidal in shape, providing maximum contact surface to the protected material and minimum contact surface to the protecting material. An alternative shape may be based on loose wires in an adhesive substrate, where these wires have entirely smooth surfaces and a small diameter such that adhesion occurs between multiple contact points with the wires in the adhesive layer and the superposed protecting layer. An abrasive component may be added to the underside of the protecting material, where pieces of the protecting material jut out and can make contact to an adhesive layer placed between these contact points and the protected material. Further, any other insulating material may be used between the protected and protecting materials whereby a magnetic force is applied to the protecting material such that it maintains a close proximity to the protected material and does not permit any opportunities for barnacle-containing sea water to touch the protected surface without passing through the protecting material.

In the foregoing disclosure, implementations of the disclosure have been described with reference to specific example implementations thereof. It will be evident that various modifications may be made thereto without departing from the broader spirit and scope of implementations of the disclosure as set forth in the following claims. The disclosure and drawings are, accordingly, to be regarded in an illustrative sense rather than a restrictive sense.

What is claimed is:

1. A method for configuring an anti-biofouling layer, comprising:

placing a porous layer upon an adhesive layer; and binding a first layer, the first layer comprising a first plurality of wire strands, between the porous layer and a second layer, the second layer comprising a second plurality of wire strands, wherein binding comprises:

(i) applying a replaceable staple ("staple") upon a portion of the second layer the applied staple passing through one or more opening portions amongst the second plurality of wire strands of the second layer prior to passing through one or more opening portions amongst the first plurality of wire strands of the first layer; and (ii) attaching the staple to one or more portions of the porous layer; and generating an extent of surface tension at the bound first and second layers due to presence of one or more air gaps between the porous layer and the bound first and second layers, each of the one or more air gaps corresponding to (a) respective pores in the porous layer and (b) the one or more opening portions of at least one of the first and the second plurality of wire strands of the bound layers.

2. The method of claim 1, wherein the second wire strand layer comprises an outer layer; and wherein applying the staple comprises initially applying the staple upon the outer layer.

3. The method of claim 1, wherein the replaceable staple further comprises a removeable staple.

4. The method of claim 1, wherein a diameter of each respective wire strand of the first and the second plurality of wire strands is less than or equal to 50 microns.

5. The method of claim 4, wherein each of the first and the second plurality of wire strands comprise a wire strand pattern that includes opening portions between the respective wire strands, each respective opening portion is less than or equal to 50 microns.

6. The method of claim 5, wherein the first and the second plurality of wire strands each comprises a plurality of stainless-steel wire strands.

7. The method of claim 5, wherein each of the first and the second plurality of wire strands comprise respective woven wire mesh.

8. The method of claim 7, wherein the wire strand pattern comprises a wire mesh strand pattern, wherein a respective wire strand pattern includes opening portions less than 29 microns.

9. The method of claim 7, wherein a diameter of respective wiring of the wire strand pattern layer is less than 21 microns.

10. The method of claim 1, further comprising:

affixing the adhesive layer upon a portion of a boat hull.

11. An anti-biofouling apparatus comprising:

an adhesive layer disposed on a first side of a porous layer;

a plurality of bound wire mesh layers attached to a second side of the porous layer, wherein the bound wire mesh layers comprise an intermediary layer between second side of the porous layer and an outer layer, the intermediary layer comprising a first plurality of wire strands and the outer layer comprising a second plurality of wire strands;

a crimping mechanism initially applied to the outer layer, the crimping mechanism binding together each wire mesh layer in the bound wire mesh layers, the crimping mechanism further attached to the second side of the porous layer; and one or more pores of the porous layer corresponding to one or more air gaps between the bound wire mesh layers and the porous layer and a presence of an extent of surface tension at the bound wire mesh layer, each of the one or more air gaps further correspond to one or more opening portions of at least one wire strand layer in the bound wire strand layers.

12. The apparatus of claim 11, wherein the crimping mechanism comprises at least one removable staple.

13. The apparatus of claim 11, wherein a wire strand diameter in the bound wire mesh layers is less than 21 microns and each respective opening portion of a wire mesh layer is less than 29 microns.

14. The apparatus of claim 11, wherein a wire strand diameter in the bound wire mesh layers is less than or equal to 50 microns and each respective opening portion of a wire mesh layer is less than or equal to 50 microns.

* * * * *